US007449043B2

(12) United States Patent
Collin et al.

(10) Patent No.: US 7,449,043 B2
(45) Date of Patent: Nov. 11, 2008

(54) CEMENTED CARBIDE TOOL AND METHOD OF MAKING THE SAME

(75) Inventors: Marianne Collin, Skarpnäck (SE); Susanne Norgren, Huddinge (SE); Håkan Engström, Bromma (SE)

(73) Assignee: Sandvik Intellectual Property Aktiebolag, Sandviken (SE)

( * ) Notice: Subject to any disclaimer, the term of this patent is extended or adjusted under 35 U.S.C. 154(b) by 384 days.

(21) Appl. No.: 11/011,185

(22) Filed: Dec. 15, 2004

(65) Prior Publication Data

US 2005/0129951 A1 Jun. 16, 2005

(30) Foreign Application Priority Data

Dec. 15, 2003 (SE) ..... 0303360
Dec. 22, 2003 (SE) ..... 0303487

(51) Int. Cl.
*C22C 29/08* (2006.01)

(52) U.S. Cl. ..... 75/240; 428/547

(58) Field of Classification Search ..... 75/240
See application file for complete search history.

(56) References Cited

U.S. PATENT DOCUMENTS

| | | | | |
|---|---|---|---|---|
| 4,359,335 | A | 11/1982 | Garner | |
| 4,743,515 | A | 5/1988 | Fischer et al. | |
| 4,843,039 | A | 6/1989 | Akesson et al. | |
| 5,403,652 | A | 4/1995 | Drougge | |
| 5,623,723 | A | 4/1997 | Greenfield | |
| 5,856,626 | A | 1/1999 | Fischer et al. | |
| 5,945,207 | A | 8/1999 | Kutscher et al. | |
| 5,948,523 | A | 9/1999 | Carpenter et al. | |
| 6,267,797 | B1 | 7/2001 | Ostlund et al. | |
| 2004/0009088 | A1 * | 1/2004 | Glatzle et al. | 419/14 |
| 2005/0147850 | A1 | 7/2005 | Tillman et al. | |

FOREIGN PATENT DOCUMENTS

| | | | |
|---|---|---|---|
| EP | 0 194 018 | A1 | 9/1986 |
| EP | 0 257 869 | A2 | 3/1988 |
| EP | 0 344 421 | B1 | 12/1989 |
| EP | 0 438 916 | B2 | 7/1991 |
| EP | 0 499 223 | B1 | 8/1992 |
| EP | 0 687 744 | B1 | 12/1995 |
| EP | 0 951 576 | B1 | 10/1999 |
| JP | 4128330 | * | 4/1992 |
| WO | 98/28455 | A1 | 7/1998 |

OTHER PUBLICATIONS

O. Eso et al., "Liquid Phase Sintering of Functioally Graded WC-Co Composites", *International Journal of Refractory Metals & Hard Materials 23*, (2005), pp. 233-241.

* cited by examiner

*Primary Examiner*—Roy King
*Assistant Examiner*—Ngoclan T Mai
(74) *Attorney, Agent, or Firm*—Drinker Biddle & Reath LLP

(57) ABSTRACT

A cemented carbide tool comprising hard constituents in a binder phase of Co and/or Ni and at least one surface portion and an interior portion in which surface portion the grain size is smaller than in the interior portion is disclosed. The surface portion with the fine grain size has a lower binder phase content than the interior portion. A method to form the cemented carbide cutting tool is also disclosed.

54 Claims, 4 Drawing Sheets

CEMENTED CARBIDE TOOL AND METHOD OF MAKING THE SAME

RELATED APPLICATION DATA

This application is based on and claims priority under 35 U.S.C. §119 to Swedish Application No. 0303360-2, filed Dec. 15, 2003, the entire contents of which are incorporated herein by reference. This application is also based on and also claims priority under 35 U.S.C. §119 to Swedish Application No. 0303487-3, filed Dec. 22, 2003, the entire contents of which are incorporated herein by reference.

FIELD OF THE DISCLOSURE

The present disclosure relates to a cemented carbide tool for metal cutting or metal forming made via sintering techniques. More specifically, the disclosure pertains to a cemented carbide tool that is made via sintering techniques wherein there are two distinct microstructural zones having complementary properties.

STATE OF THE ART

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

In cemented carbides the grain size, as well as the binder phase (e.g., cobalt) content, each has an influence on the performance of the composite. For example, a smaller or finer grain size of the tungsten carbide results in a more wear resistant material. An increase in cobalt content typically leads to an increase in toughness.

Cemented carbides having a fine grain size are produced through the incorporation of grain refiners in the initial powder blend. Such cemented carbide has a fine grain size throughout its microstructure. Cemented carbide with a coarse grain size is produced via sintering without the incorporation of any grain refiners since the tendency of a cemented carbide like a WC-Co composite is for the WC grains to coarsen during sintering. Such cemented carbide has a coarse grain size throughout its microstructure. As can be appreciated these hard bodies have a uniform microstructure throughout.

Cemented carbide products are widely used in tools for metal machining, as well as for different coldforming operations of materials like steels, copper alloys, composite materials, etc. Examples of the latter type of tools are wire drawing dies, which are a cemented carbide nib usually fit into a steel or metal holder. Such tools should have a hard and wear resistant surface zone, which also should have the following additional properties: good thermal conductivity; low coefficient of friction, i.e., it may be self lubricating or assist lubrication with a coolant; good corrosion resistance; resistance to microcracking; and high toughness.

Cemented carbide bodies having at least two distinct microstructural zones are known in the art. For example, drills having a core of a tough cemented carbide grade and a cover of a more wear resistant grade are disclosed in EP-A-951576.

EP-A-194018 relates to a wire drawing die made from a central layer with coarse grained tungsten carbide particles and a peripheral layer with finer grained tungsten carbide particles. Initially, the layers have the same content of cobalt. After sintering, the coarse grained layer in the center is reduced in cobalt content.

EP-A-257869 discloses a rock bit button made with a wear resistant tip portion and a tough core. The tip portion is made from a powder with low Co-content and a fine WC grain size and the core portion is made from a powder with high Co content and coarse WC grains. Nothing is disclosed about the Co-content in the two portions after sintering. However, also in this case the Co-content in the coarse grained portion will be reduced at the benefit of the Co-content in the fine grained layer. A similar disclosure is found in U.S. Pat. No. 4,359,335.

An alternative approach is disclosed in U.S. Pat. No. 4,843,039, which discloses cemented carbide bodies preferably for cutting tool inserts for metal machining. The bodies comprise a core of cemented carbide containing eta-phase surrounded by a surface zone of cemented carbide free of eta-phase and having a low content of cobalt in the surface and a higher content of cobalt next to the eta-phase zone. U.S. Pat. No. 4,743,515 is similar, but it relates to rock drilling and mineral cutting.

U.S. Pat. No. 5,623,723 discloses a method of making a cemented carbide body with a wear resistant surface zone. The method includes the following steps: providing a compact of cemented carbide; placing a powder of grain refiner on at least one portion of the exposed surface of the compact; and heat treating the compact and grain refiner powder so as to diffuse the grain refiner toward the center of the green compact thereby forming a surface zone inwardly from the exposed surface in which the grain refiner was placed, and forming an interior zone. As a result, a cemented carbide body is obtained with a surface zone having a grain size that is smaller but with a Co-content that is higher than that of the interior portion of the body. This means that the increased wear resistance that is obtained as a result of the smaller WC grain size is to a certain extent lost by the increase in Co-content.

SUMMARY

Exemplary embodiments of a cemented carbide tool with a surface zone with low binder phase content and fine WC grain size and thus high wear resistance and exemplary methods making the same are provided.

An exemplary embodiment of a cemented carbide cutting for metal cutting or metal forming comprises a cemented carbide body comprising hard constituents in a binder phase of Co and/or Ni, and at least one surface portion and an interior portion. The surface portion has a smaller WC grain size than the interior portion. The surface portion with the smaller WC grain size has a lower binder phase content than the interior portion.

An exemplary method of making a cemented carbide body with a wear resistant surface zone comprises providing a compact of cemented carbide from a single powder mixture, optionally presintering the compact and grinding the compact to a desired shape and size, placing a powder of a grain refiner containing carbon and/or nitrogen on at least one portion of an exposed surface of the compact, the grain refiner containing C and/or N, sintering the compact and grain refiner powder so as to diffuse the grain refiner toward the center of the compact to form a surface portion in the sintered compact and to form an interior portion in the sintered compact, optionally adding an isostatic gas pressure during a final stage of sintering, optionally post-HIP-ing at a temperature lower than the sintering temperature and at a pressure of 1 to 100 MPa, optionally grinding to final shape, and optionally depositing a wear resistant coating on a surface of the sintered compact. Sintering obtains a dense body. The surface portion has a WC grain size smaller than the interior portion and the surface portion has a cobalt content lower than in the interior portion.

An exemplary embodiment of a cemented carbide cutting tool insert for metal machining comprises a cemented carbide body comprising hard constituents in a binder phase of Co and/or Ni and at least one surface portion and an interior portion. The surface portion has a WC grain size less than 0.9 the WC grain size in the interior portion and the surface portion with the smaller grain size has a binder phase content less than 0.92 the binder phase content in the interior portion. The surface portion contains Cr and a ratio of parameter A to parameter B is greater than 1.2, where parameter A=[(wt-% Cr/wt-% binder phase)+0.01] in the surface portion and parameter B=[(wt-% Cr/wt-% binder phase)+0.01] taken at a part of the cemented carbide body having the lowest Cr content.

BRIEF DESCRIPTION OF THE DRAWING FIGURES

The following detailed description of preferred embodiments can be read in connection with the accompanying drawings in which like numerals designate like elements and in which.

DETAILED DESCRIPTION OF PREFERRED EMBODIMENTS

Figure 1:
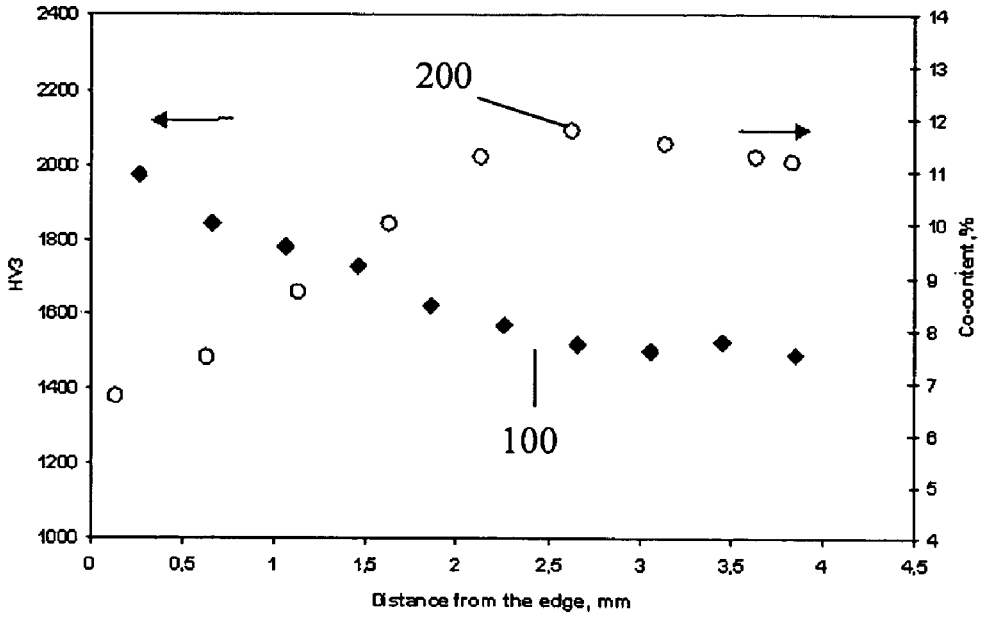
FIG. 1 is a graph showing hardness (HV3) and cobalt content versus distance from the edge in an exemplary embodiment of a tool.

It has now surprisingly been found that it is possible from a single mixture of tungsten carbide and binder phase to obtain a cemented carbide body with a surface portion with a smaller grain size and lower cobalt content than those in the interior portion.

According to the present disclosure, there is provided a cemented carbide tool for metal cutting or metal forming comprising a cemented carbide body comprising hard constituents in a binder phase of Co and/or Ni. The cemented carbide body comprises at least one surface portion, 0 to 2000 μm thick, and an interior portion. The thickness of the surface portion can vary from 0 to 2000 μm, for example, 5 to 1200 μm, alternatively 10 to 800 μm, and alternatively 10 to 300 μm. In the surface portion, the WC grain size is smaller than in the interior portion and the binder phase content is lower than that in the interior portion. Also, the Cr-content is higher in the surface portion than that in the interior portion.

In an exemplary embodiment, the binder phase content of the surface portion is <1, alternatively <0.92, alternatively <0.85, of the binder phase content in the interior portion and the WC grain size of the surface portion is <1.0, alternatively <0.9, alternatively <0.8, of the WC grain size in the interior portion.

In another exemplary embodiment, the surface portion contains Cr such that the ratio between the parameter A=[(wt-% Cr/wt-% binder phase)+0.01] in the surface portion and the parameter B=[(wt-% Cr/wt-% binder phase)+0.01] taken at the part of the body that is characterized by the lowest Cr content is A/B >1.2, alternatively A/B >1.5, alternatively in some exemplary embodiments, A/B>3.0.

The WC grain size in the surface portion can vary. For example, the WC grain size in the surface portion can be submicron. In a second example, the WC grain size in the interior portion is 1 to 3 microns.

In some exemplary embodiments, the composition of the cemented carbide is WC+Co with a binder phase content >1.5 wt-%. For example, the binder phase content in some exemplary embodiments can be >1.5 wt-%, alternatively >5 wt-%. Also for example, the binder phase content in some exemplary embodiments can be <25 wt-%, alternatively <15 wt-%.

In further exemplary embodiments, the cemented carbide can in addition contain a proportion of gamma-phase (γ-phase). For example, the cemented carbide can contain 0-30 vol-% gamma-phase. Alternatively, the cemented carbide can contain 0.2-16 vol-% gamma-phase or 0.4-9 vol-% gamma phase.

In still further exemplary embodiments, the cemented carbide tool is a cutting tool insert for metal machining. It is obvious to the man skilled in the art that features of the disclosed cemented carbide tool and method can be applied to other cemented carbide cutting tools, such as endmills and drills. In further exemplary embodiments, the cemented carbide tool is a coldforming tool. Other examples of uses of cemented carbide in forming applications are from such variable fields as the forming of beverage cans, bolts, nails and other applications known to the person skilled in the art.

Grain refiners such as VC and $Cr_3C_2$ can optionally be added to all embodiments. Also, exemplary embodiments of disclosed cemented carbide tools may further optionally be provided with a wear resistant coating as known in the art, preferably 1 to 40 μm thick, alternatively 1 to 15 μm thick.

An exemplary method of making a cemented carbide body for metal or metal forming, such as a cutting tool insert for chip forming machining or a coldforming tool, with a wear resistant surface zone comprises the following steps:

- providing a compact of cemented carbide made from one single powder mixture, the single powder mixture comprising powders forming hard constituents, optional grain refiners such as VC and $Cr_3C_2$, and a binder phase of Co and/or Ni;
- placing a powder of a grain refiner on at least one portion of the exposed surface of the compact by dipping, spraying, painting, applying a thin tape or in any other way. The grain refiner in one exemplary method being any chromium carbide (e.g., $Cr_3C_2$, $Cr_{23}C_6$ and $Cr_7C_3$ or mixtures of these) or a mixture of chromium and carbon or other compounds containing chromium and carbon and/or nitrogen;
- sintering the compact and grain refiner powder so as to diffuse the grain refiner away from the surface(s) on which the grain refiner was placed to form a gradient zone in a surface portion of the sintered counterpart, the gradient zone having a lower cobalt content, a higher chromium content and a lower WC grain size as compared to an interior portion of the sintered compact;

optionally adding an isostatic gas pressure during a final stage of sintering to obtain a dense body;

optionally reducing a thickness of the surface portion using grinding or any other mechanical method;

optionally removing undesired carbides and graphite from the surface of the sintered compact using grinding or any other mechanical method;

optionally depositing a wear resistant coating on the surface of the sintered compact; and for a tool that is a cutting insert, optionally performing an edge treatment as known in the art.

The carbon content of the cemented carbide compact can be determined out of consideration for the carbon contribution from the applied chromium carbide. For example, in the case of γ-phase containing cemented carbide, the chromium solubility in the γ-phase has to be compensated for. Also, for example, compacts that would result in an eta-phase containing microstructure can be used.

The sintering can be performed for optimal time to obtain the desired structure and a body with closed porosity, preferably a dense body. This time depends on the grain size of WC and the composition of the cemented carbide. It is within the purview of the person skilled in the art to determine whether the requisite structure has been obtained and to modify the sintering conditions in accordance with the present specification. If necessary or desired, the body can optionally be post-HIP-ed at a lower HIP-temperature compared to the sintering temperature and at a pressure of 1 to 100 MPa.

Alternatively in some exemplary embodiments, the grain refiner powder is placed on a sintered body which is subsequently heat treated to obtain the desired structure at a temperature higher than that for pre-sintering.

EXAMPLE 1

Cemented carbide pressed compacts in the style B-SNGN120408 were made according to the following: Green compacts were pressed from a powder with the composition of 90 weight-% WC and 10 weight-% Co. The WC raw material was fine-grained with an average grain size of 0.25 μm (FSSS). The rake faces were covered with a $Cr_3C_2$ containing layer (0.02 g $Cr_3C_2$ /cm$^2$). Thereafter the compacts were sintered at 1370° C. for 30 minutes whereafter the outer 1 mm deep portion was removed by grinding.

Figure 2:
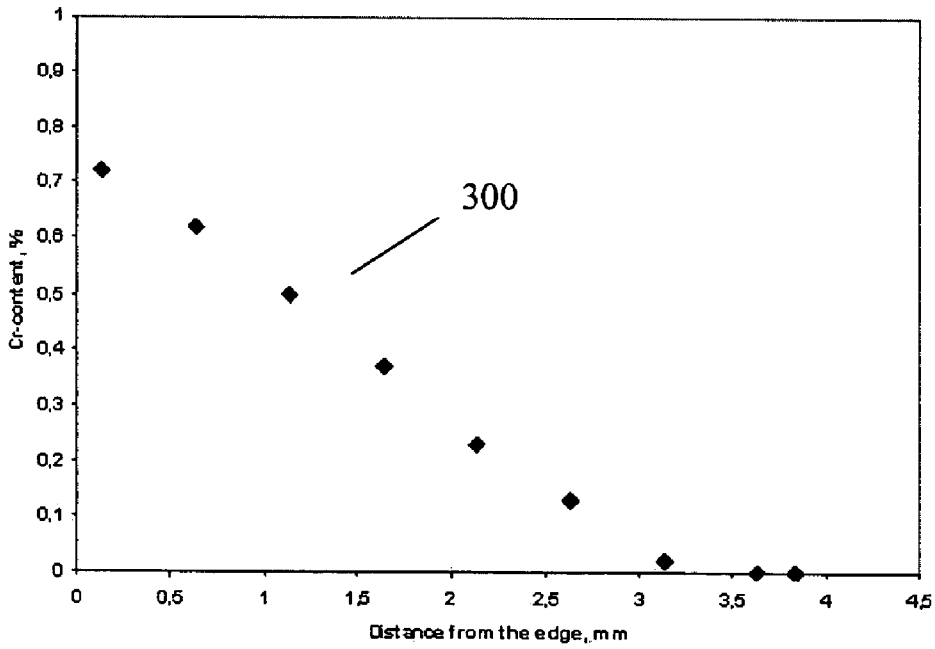
FIG. 2 is a graph showing chromium content versus distance from the edge in the exemplary embodiment of a tool.
Figure 3:
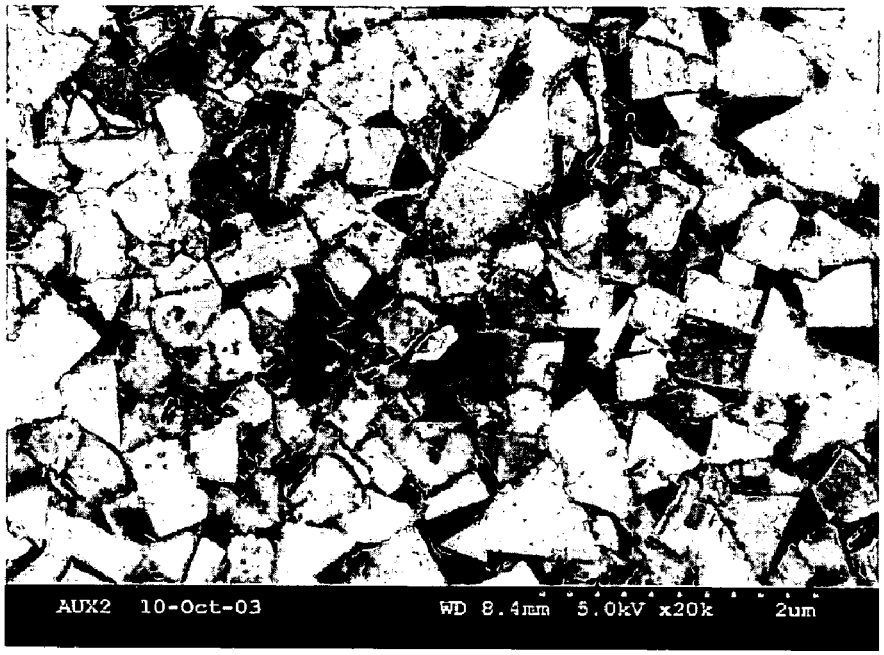
FIG. 3 is a micrograph showing the microstructure at a distance of 100 μm from the edge (FEG-SEM, 20000X, BSE mode) in a the exemplary embodiment of a tool.
Figure 4:
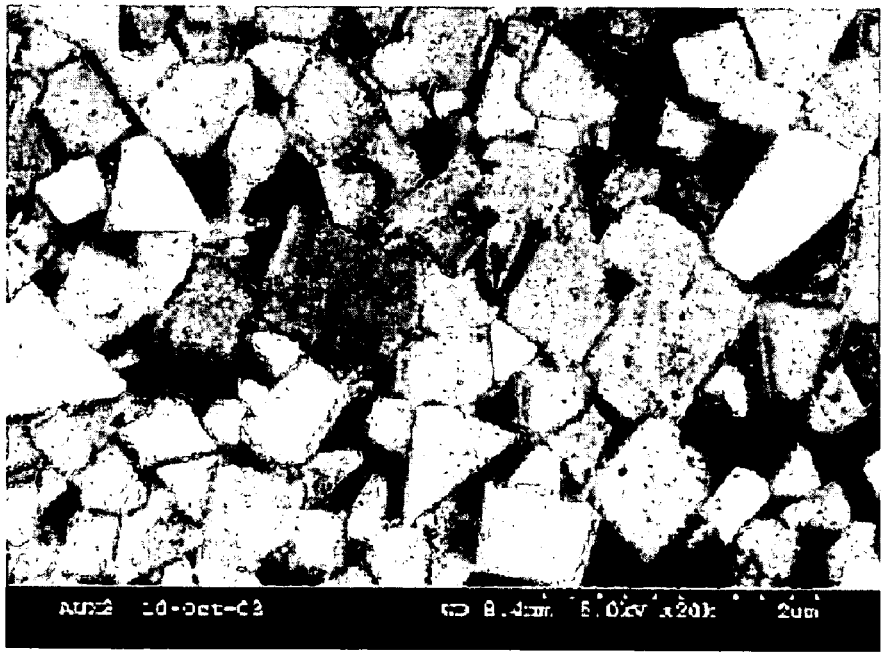
FIG. 4 is a micrograph showing the microstructure at a distance of 3 mm from the edge (FEG-SEM, 20000X, BSE mode) in the exemplary embodiment of a tool.

A cross-section of a sintered and ground blank was examined. FIG. 1 shows a graph of hardness 100 and cobalt content 200 versus the distance from the edge. The cobalt content 200 is lowest close to the edge and increases with increasing distance while the hardness 100 is highest close to the edge and decreases with the distance. FIG. 2 shows a graph of chromium content 300 versus the distance from the edge. The chromium content 300 is highest close to the edge and decreases with the distance. Cobalt and chromium contents were measured using EPMA (electron probe microanalyser). FIG. 3 is a micrograph showing the microstructure at a distance of 100 μm from the edge (FEG-SEM, 20000X, BSE mode). FIG. 4 is a micrograph showing the microstructure at a distance of 3 mm from the edge (FEG-SEM, 20000X, BSE mode). The WC-grain size 100 μm from the edge and 3 mm from the edge was measured as 0.28 μm and 0.36 μm, respectively (arithmetic mean of linear intercept values).

EXAMPLE 2

Cemented carbide pressed compacts in the style B-SNGN120408 were made according to the following: Green compacts were pressed from a powder with the composition of 94 weight-% WC and 6 weight-% Co. The WC raw material was relatively fine-grained with an average grain size of 0.25 μm (FSSS). The rake faces were covered with 0.007 g/cm$^2$ of $Cr_3C_2$. The pressed compacts with $Cr_3C_2$-layers were sintered at 1350° C. for 30 minutes and post-HIP-ed at 1300° C. and 6 MPa for 30 minutes.

A cross-section of a sintered blank was examined. No $Cr_3C_2$ was observed on the surface. The following table shows HV3, cobalt-content, chromium-content and WC grain size for this example:

| | |
|---|---|
| HV3 100 μm from the edge | 1720 |
| HV3 3 mm from the edge | 1520 |
| Co-content 100 μm from the edge, weight-% | 4.0 |
| Co-content 3 mm from the edge, weight-% | 6.5 |
| Cr-content 100 μm from the edge, weight-% | 0.7 |
| Cr-content 3 mm from the edge, weight-% | <0.05 |
| WC grain size 100 μm from the edge, μm | 0.7 |
| WC grain size 3 mm from the edge, μm | 0.9 |

EXAMPLE 3

Cemented carbide pressed compacts in the style B-SNGN120408 were made according to the following: Green compacts were pressed from a powder with the composition of 90 weight-% WC and 10 weight-% Co. The rake faces were covered with a $Cr_3C_2$ containing layer (0.01 g $Cr_3C_2$ /cm$^2$). Thereafter, the compacts were sintered at 1370° C. for 30 minutes.

A cross-section of a sintered blank was examined. No $Cr_3C_2$ was observed on the surface. The following table shows HV3, cobalt-content, chromium-content and WC grain size for this example:

| | |
|---|---|
| HV3 100 μm from the edge | 1450 |
| HV3 3 mm from the edge | 1280 |
| Co-content 100 μm from the edge, weight-% | 7.5 |
| Co-content 3 mm from the edge, weight-% | 11 |
| Cr-content 100 μm from the edge, weight-% | 0.4 |
| Cr-content 3 mm from the edge, weight-% | <0.05 |
| WC grain size 100 μm from the edge, μm | 1.1 |
| WC grain size 3 mm from the edge, μm | 1.4 |

EXAMPLE 4

Cemented carbide pressed compacts in the style B-SNGN120408 were made according to the following: Green compacts were pressed from a powder with the composition of 90 weight-% WC and 10 weight-% Co. The WC raw material was fine-grained with an average grain size of 0.25 μm (FSSS). The rake faces were covered with a $Cr_3C_2$ containing layer (0.018 g $Cr_3C_2$/cm$^2$). Thereafter, the compacts were sintered at 1410° C. for 60 minutes.

A cross-section of a sintered blank was examined. No $Cr_3C_2$ was observed on the surface. The following table shows HV3, cobalt-content, chromium-content and WC grain size for this example:

| | |
|---|---|
| HV3 100 μm from the edge | 1750 |
| HV3 4 mm from the edge | 1480 |
| Co-content 100 μm from the edge, wt-% | 9.0 |
| Co-content 4 mm from the edge, wt-% | 10.5 |
| Cr-content 100 μm from the edge, wt-% | 0.5 |
| Cr-content 4 mm from the edge, wt-% | 0.1 |
| WC grain size 100 μm from the edge, μm | 0.32 |
| WC grain size 4 mm from the edge, μm | 0.58 |

EXAMPLE 5

Cemented carbide pressed compacts in the style B-SNGN120408 were made according to the following: Green compacts were pressed from a powder with the composition of 94 weight-% WC and 6 weight-% Co. The WC raw material was submicron. The pressed compacts were sintered at 1370° C. The sintered blanks were ground into style SNKN1204 EN and covered with a $Cr_3C_2$-containing tape (0.01 g $Cr_3C_2/cm^2$) on the clearance face and resintered at a sintering temperature of 1390° C. for 15 minutes.

A cross-section of a sintered blank was examined. No $Cr_3C_2$ was observed on the surface. The following table shows HV3, cobalt-content, chromium-content and WC grain size for this example:

| | |
|---|---|
| HV3 100 μm from the edge | 1820 |
| HV3 3 mm from the edge | 1700 |
| Co-content 100 μm from the edge, weight-% | 5.0 |
| Co-content 3 mm from the edge, weight-% | 6.5 |
| Cr-content 100 μm from the edge, weight-% | 0.22 |
| Cr-content 3 mm from the edge, weight-% | <0.05 |
| WC grain size 100 μm from the edge, μm | 0.4 |
| WC grain size 3 mm from the edge, μm | 0.6 |

EXAMPLE 6

Cemented carbide pressed compacts in the style B-SNGN120408 were made according to the following: Green compacts were pressed from a powder with the composition of 77 weight-% WC, 6 weight-% TaC, 2 weight-% NbC, 4 weight-% TiC and 11 weight-% Co. The compacts were covered with a $Cr_3C_2$-containing tape (0.02 g $Cr_3C_2/cm^2$) and sintered at a sintering temperature of 1370° C. for 30 minutes and thereafter HIP-ed at 1200° C. and 100 MPa for 60 minutes.

A cross-section of a sintered blank was examined. The cobalt content and the WC grain size were significantly lower close to the edge compared to the interior as was verified through the following HV3 values.

| | |
|---|---|
| HV3 100 μm from the edge | 1470 |
| HV3 3 mm from the edge | 1300 |

EXAMPLE 7

Inserts were produced according to the following:

Composition: 91.6 weight-% WC+0.23 weight-% TaC+0.16 weight-% NbC+8.0 weight-% Co Style: CNMG120408-QM Sintering temperature: 1370° C.

The inserts were given a rounded cutting edge and thereafter split into two variants. Variant A was covered with $Cr_3C_2$ on the rake face according to the methods and procedures described herein using a painting technique resulting in a layer of about 0.01 g $Cr_3C_2/cm^2$. Variant B was not covered with $Cr_3C_2$.

For the rest of the manufacturing, the two variants were dealt with together and in the same way involving resintering at 1390° C. for 15 minutes, blasting, cleaning and coating with a 4 μm thick TiAlN PVD-layer. Cross-sections of each variant were examined. No $Cr_3C_2$ was observed between the TiAlN-layer and the cemented carbide material on Variant A. The following table shows cobalt-content, chromium-content and WC grain size for this example:

| | Variant A | Variant B |
|---|---|---|
| Co-content 100 μm from the edge, weight-% | 7.0 | 8.0 |
| Co-content 3 mm from the edge, weight-% | 8.5 | 8.0 |
| Cr-content 100 μm from the edge, weight-% | 0.2 | <0.05 |
| Cr-content 3 mm from the edge, weight-% | <0.05 | <0.05 |
| WC grain size 100 μm from the edge, μm | 0.55 | 0.7 |
| WC grain size 3 mm from the edge, μm | 0.7 | 0.7 |

The inserts were tested in a facing operation in order to compare the resistance to plastic deformation: The following provides details on the facing operation:

Workpiece: Inconel 718

Cutting depth: 1 mm

Feed: 0.25 mm/rev

Cutting speed: 80 to 140 m/min

Result (maximum cutting speed for keeping plastic deformation below 0.25 mm):

Variant A: 120 m/min

Variant B: 100 m/min

These results indicate that treatment of Variant A according to the methods and procedures described herein gives better resistance to plastic deformation than Variant B.

EXAMPLE 8

Cemented carbide pressed compacts were made according to the following: A cylindrical green compact were pressed from a powder with the composition of 96.7 weight-% WC and 3.3 weight-% Co and 0.2% VC. The WC raw material was relative fine-grained with an average grain size of 0.8 μm (FSSS). One surface was covered with a $Cr_3C_2$ containing layer (0.02 g $Cr_3C_2/cm^2$). Thereafter the compacts were sintered at 1370° C. for 30 minutes.

Figure 5:
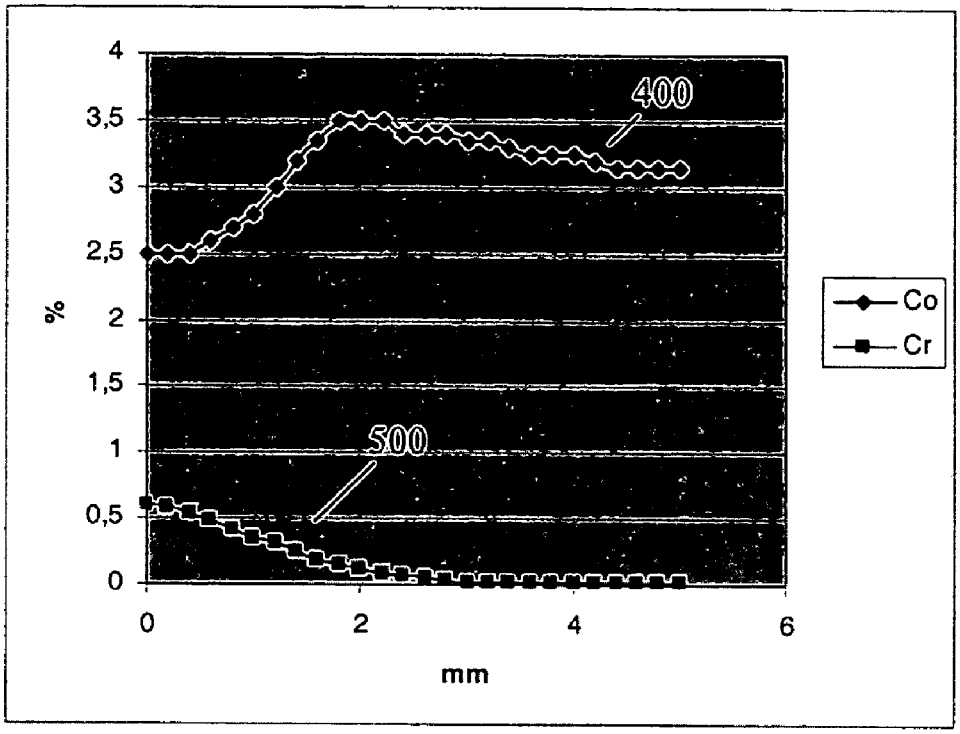
FIG. 5 is a graph showing cobalt content versus distance to the previously $Cr_3C_2$-covered surface and also showing chromium content versus distance to the previously $Cr_3C_2$-covered surface in another exemplary embodiment of a tool.
Figure 6:
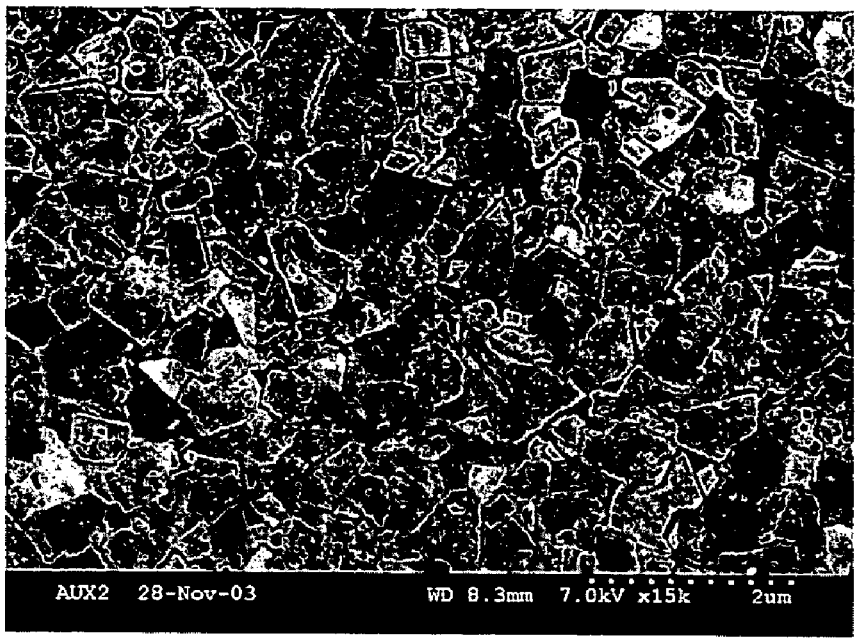
FIG. 6 is a micrograph showing the microstructure at a distance of 100 μm from the surface where the $Cr_3C_2$-powder was placed (FEG-SEM, 15000X, BSE mode).
Figure 7:
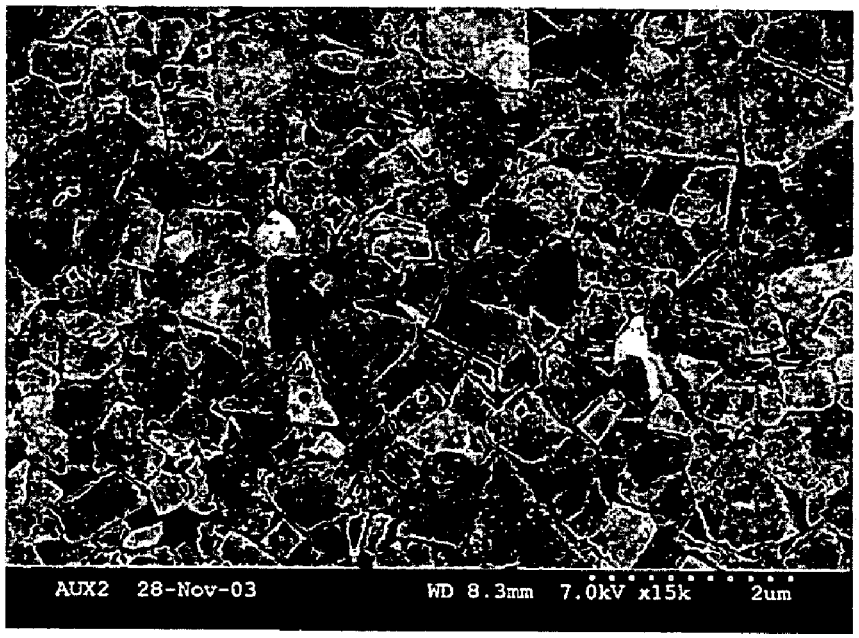
FIG. 7 is a micrograph showing the microstructure at a distance of 3 mm from the surface where the $Cr_3C_2$-powder was placed (FEG-SEM, 15000X, BSE mode).

A cross-section of the sintered body was examined. Cobalt and chromium contents were measured using EPMA (electron probe microanalyzer). FIG. 5 is a graph showing cobalt content 400 versus the distance from the previously $Cr_3C_2$-covered surface. The cobalt content 400 is lowest close to the surface and increases with increasing distance, showing a tendency to formation of a Co richer zone between the surface and the bulk. FIG. 5 also shows the chromium content 500 versus the distance from the previously $Cr_3C_2$-covered surface. The chromium content 500 is highest close to the surface and decreases with the distance. FIG. 6 is a micrograph showing the microstructure at a distance of 100 μm from the surface where the $Cr_3C_2$ powder was placed (FEG-SEM, 15000X, BSE mode). FIG. 7 is a micrograph showing the microstructure at a distance of 3 mm from the surface where the $Cr_3C_2$ powder was placed (FEG-SEM, 15000X, BSE mode). The following table shows cobalt-content, chromium-content and WC grain size (measured as arithmetic mean of intercept values) for this example:

| | |
|---|---|
| Co-content 100 μm from the surface, wt-% | 2.6 |
| Co-content 3 mm from the surface, wt-% | 3.3 |
| Cr-content 100 μm from the surface, wt-% | 0.6 |
| Cr-content 3 mm from the surface, wt-% | <0.05 |
| WC grain size 100 μm from the surface, μm | 0.35 |
| WC grain size 3 mm from the surface, μm | 0.44 |

EXAMPLE 9

Cemented carbide pressed compacts in the style B-SNGN120408 were made according to the following: Green compacts were pressed from a powder with the composition of 90 weight-% WC and 10 weight-% Co. The WC raw material was fine-grained with an average grain size of 0.25 μm (FSSS). The rake faces were covered with a $Cr_3C_2$ containing layer of 0.036 g $Cr_3C_2/cm^2$. Thereafter the compacts were sintered at 1370° C. for 270 minutes. A cross-section of a sintered blank was examined. No $Cr_3C_2$ was observed on the surface. The following table shows HV3, cobalt-content, chromium-content and WC grain size for this example:

| | |
|---|---|
| HV3 100 μm from the edge | 1710 |
| HV3 4 mm from the edge | 1600 |
| Co-content 100 μm from the edge, weight-% | 9.6 |
| Co-content 4 mm from the edge, weight-% | 10.3 |
| Cr-content 100 μm from the edge, weight-% | 0.39 |
| Cr-content 4 mm from the edge, weight-% | 0.28 |
| WC grain size 100 μm from the edge, μm | 0.3 |
| WC grain size 4 mm from the edge, μm | 0.4 |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cemented carbide tool for metal cutting or metal forming comprising:

a cemented carbide body comprising:

hard constituents in a binder phase of Co and/or Ni; and at least one surface portion and an interior portion, wherein the surface portion has a smaller WC grain size than the interior portion, wherein the surface portion with the smaller WC grain size has a lower binder phase content than the interior portion, wherein the surface portion contains Cr, wherein a ratio of parameter A to parameter B is greater than 3.0, where parameter A=[(wt-% Cr/wt-% binder phase)+0.01] in the surface portion and parameter B=[(wt-% Cr/wt-% binder phase)+0.01] taken at a part of the cemented carbide body having the lowest Cr content, wherein a maximum in Co-content occurs at a location in the cemented carbide body between an outermost surface of the surface portion and an outermost region of the interior portion, and wherein the Co-content in a region inward of the location of the maximum in Co-content is lower than the maximum.

2. The cemented carbide tool according to claim 1, wherein the binder phase content of the surface portion is less than 0.92 of that in the interior portion.

3. The cemented carbide tool according to claim 2, wherein the binder phase content of the surface portion is less than 0.85 of that in the interior portion.

4. The cemented carbide tool according to claim 1, wherein the WC grain size in the surface portion is less than 0.9 of that in the interior portion.

5. The cemented carbide tool according to claim 4, wherein the WC grain size in the surface portion is less than 0.8 of that in the interior portion.

6. The cemented carbide tool according to claim 1, wherein a thickness of the surface portion is 0 to 2000 μm.

7. The cemented carbide tool according to claim 6, wherein the thickness of the surface portion is 5 to 1200 μm.

8. The cemented carbide tool according to claim 7, wherein the thickness of the surface portion is 10 to 800 μm.

9. The cemented carbide tool according to claim 8, wherein the thickness of the surface portion is 10 to 300 μm.

10. The cemented carbide tool according to claim 1, wherein a composition of the cemented carbide body is WC+Co with a binder phase content of greater than 1.5 wt-% and less than 25 wt-%.

11. The cemented carbide tool according to claim 10, wherein the binder phase content in the surface portion is greater than 5 wt-%.

12. The cemented carbide tool according to claim 10, wherein the binder phase content in the surface portion is less than 15 wt-%.

13. The cemented carbide tool according to claim 1, wherein a composition of the cemented carbide body is WC+Co with a binder phase content of greater than 1.5 wt-% and less than 25 wt-% and a gamma-phase content of 0 to 30 vol-%.

14. The cemented carbide tool according to claim 13, wherein the binder phase content in the surface portion is greater than 5 wt-%.

15. The cemented carbide tool according to claim 13, wherein the binder phase content in the surface portion is less than 15 wt-%.

16. The cemented carbide tool according to claim 13, wherein the gamma-phase content is 0.2 to 16 vol-%.

17. The cemented carbide tool according to claim 1, wherein the tool is a cutting tool insert.

18. The cemented carbide toot according to claim 1, wherein the tool is a coldforming tool.

19. The cemented carbide tool according to claim 1, comprising a wear resistant coating on an outer surface.

20. A cemented carbide cutting tool insert for metal machining comprising a cemented carbide body comprising hard constituents in a binder phase of Co and/or Ni and at least one surface portion and an interior portion, wherein the surface portion has a WC grain size less than 0.9 a WC grain size in the interior portion, wherein the surface portion has a binder phase content less than 0.92 of a binder phase content in the interior portion, wherein the surface portion contains Cr, wherein a ratio of parameter A to parameter B is greater than 1.2, where parameter A=[(wt-% Cr/wt-% binder phase)+0.01] in the surface portion and parameter B=[(wt-% Cr/wt-% binder phase)+0.01] taken at a part of the cemented carbide body having the lowest Cr content wherein a maximum in Co-content occurs at a location in the cemented carbide body between an outermost surface of the surface portion and an outermost region of the interior portion, and wherein the Co-content in a region inward of the location of the maximum in Co-content is lower than the maximum.

21. The cemented carbide cutting tool insert according to claim 20, wherein a composition of the cemented carbide body is WC+Co with a binder phase content in the surface portion of 5 to 15 wt-% and a gamma-phase content of 0 to 30 vol-%.

22. The cemented carbide tool according to claim 20, wherein the binder phase content of the surface portion is less than 0.85 of that in the interior portion.

23. The cemented carbide tool according to claim 22, wherein the WC grain size in the surface portion is less than 0.8 of that in the interior portion.

24. The cemented carbide tool according to claim 20, wherein a thickness of the surface portion is 0 to 2000 μm.

25. The cemented carbide tool according to claim 24, wherein the thickness of the surface portion is 5 to 1200 μm.

26. The cemented carbide tool according to claim 25, wherein the thickness of the surface portion is 10 to 800 μm.

27. The cemented carbide tool according to claim 26, wherein the thickness of the surface portion is 10 to 300 μm.

28. The cemented carbide tool according to claim 20, wherein a composition of the cemented carbide body is WC+Co with a binder phase content in the surface portion of greater than 1.5 wt-% and less than 25 wt-%.

29. The cemented carbide tool according to claim 28, wherein the binder phase content in the surface portion is greater than 5 wt-%,

30. The cemented carbide tool according to claim 28, wherein the binder phase content in the surface portion is less than 15 wt-%.

31. The cemented carbide tool according to claim 20, wherein a composition of the cemented carbide body is WC+Co with a binder phase content in the surface portion of greater than 1.5 wt-% and less than 25 wt-% and a gamma-phase content of 0 to 30 vol-%.

32. The cemented carbide tool according to claim 31, wherein the binder phase content in the surface portion is greater than 5 wt-%.

33. The cemented carbide tool according to claim 31, wherein the binder phase content in the surface portion is less than 15 wt-%.

34. The cemented carbide tool according to claim 31, wherein the gamma-phase content is 0.2 to 16 vol-%.

35. The cemented carbide tool according to claim 20, comprising a wear resistant coating on an outer surface.

36. A cemented carbide tool for metal cutting or metal forming comprising:

a cemented carbide body comprising hard constituents in a binder phase of Co and/or Ni; and at least one surface portion and an interior portion, wherein the surface portion has a smaller WC grain size than the interior portion, wherein the surface portion with the smaller WC grain size has a lower binder phase content than the interior portion, wherein a composition of the cemented carbide body is WC+Co with a binder phase content in the surface portion of greater than 1.5 wt-% and less than 25 wt-% and a gamma-phase content of 0.2 to 30 vol-%.

wherein a maximum in Co-content occurs at a location in the cemented carbide body between an outermost surface of the surface portion and an outermost region of the interior portion, and wherein the Co-content in a region inward of the location of the maximum in Co-content is lower than the maximum.

37. The cemented carbide tool according to claim 36, wherein the binder phase content of the surface portion is less than 0.92 of that in the interior portion.

38. The cemented carbide tool according to claim 37, wherein the binder phase content of the surface portion is less than 0.85 of that in the interior portion.

39. The cemented carbide tool according to claim 36, wherein the WC grain size in the surface portion is less than 0.9 of that in the interior portion.

40. The cemented carbide tool according to claim 39, wherein the WC grain size in the surface portion is less than 0.8 of that in the interior portion.

41. The cemented carbide tool according to claim 36, wherein the surface portion contains Cr, and wherein a ratio of parameter A to parameter B is greater than 1.2, where parameter A=[(wt-% Cr/wt-% binder phase)+0.01] in the surface portion and parameter B=[(wt-% Cr/wt-% binder phase)+0.01] taken at a part of the cemented carbide body having the lowest Cr content.

42. The cemented carbide tool according to claim 41, wherein the ratio of parameter A to parameter B is greater than 3.0.

43. The cemented carbide tool according to claim 36, wherein a thickness of the surface portion is 0 to 2000 μm.

44. The cemented carbide tool according to claim 43, wherein the thickness of the surface portion is 5 to 1200 μm.

45. The cemented carbide tool according to claim 44, wherein the thickness of the surface portion is 10 to 800 μm.

46. The cemented carbide tool according to claim 45, wherein the thickness of the surface portion is 10 to 300 μm.

47. The cemented carbide tool according to claim 36, wherein the binder phase content in the surface portion is greater than 5 wt-%.

48. The cemented carbide tool according to claim 36, wherein the binder phase content in the surface portion is less than 15 wt-%.

49. The cemented carbide tool according to claim 36, wherein the gamma-phase content is less than 16 vol-%.

50. The cemented carbide tool according to claim 36, wherein the tool is a cutting tool insert.

51. The cemented carbide tool according to claim 36, wherein the tool is a coldforming tool.

52. The cemented carbide tool according to claim 36, comprising a wear resistant coating on an outer surface.

53. The cemented carbide tool according to claim 1, wherein a binder phase content in the surface portion is greater than 2.5 wt-% and less than 25 wt-%.

54. The cemented carbide tool according to claim 53, wherein the binder phase content in the surface portion is greater than 4 wt-%.

* * * * *